United States Patent [19]

Yamashita et al.

[11] 4,400,081

[45] Aug. 23, 1983

[54] APPARATUS FOR CLEANING PHOTOSENSITIVE MEMBER OF ELECTROSTATIC COPYING MACHINE

[75] Inventors: Tadashi Yamashita; Toyoo Okamoto, both of Yokohama, Japan

[73] Assignee: Ricoh Company, Ltd., Japan

[21] Appl. No.: 285,057

[22] Filed: Jul. 20, 1981

[30] Foreign Application Priority Data

Jul. 21, 1980 [JP] Japan ..... 55-099501
Jul. 23, 1980 [JP] Japan ..... 55-100866

[51] Int. Cl.[3] ..... G03G 15/00; G03G 15/08

[52] U.S. Cl. ..... 355/15; 355/3 DD; 355/3 CH; 355/14 CH; 361/212; 361/220; 118/652

[58] Field of Search ..... 355/15, 14 E, 14 D, 355/14 CH, 3 CH, 3 ER, 3 R; 361/212, 214, 220, 221; 118/652

[56] References Cited

U.S. PATENT DOCUMENTS 3,633,544 1/1972 Weller ..... 118/629
3,655,373 4/1972 Fisher et al. ..... 355/15 X
3,848,992 11/1974 Smith ..... 355/15
3,848,994 11/1974 Fraser ..... 355/15
4,252,433 2/1981 Sullivan ..... 355/15
4,259,003 3/1981 Mangal et al. ..... 355/15 X
4,277,161 7/1981 Calabrese ..... 355/15 X
4,297,021 10/1981 Tani et al. ..... 355/3 R
4,314,756 2/1982 Amitani et al. ..... 355/15

*Primary Examiner*—A. C. Prescott
*Attorney, Agent, or Firm*—Guy W. Shoup; Gerard F. Dunne

[57] ABSTRACT

An apparatus for cleaning a photosensitive member of an electrostatic copying machine which includes neutralizing means electrically connected to the ground and disposed for contact with the surface of a photosensitive member in a region located between a transfer station where a toner image formed on photosensitive member is transferred onto a transfer sheet and a cleaning station where any residual toner remaining on the photosensitive member after the transfer step is removed. In this manner, the photosensitive member is neutralized after the transfer step before the residual toner is removed therefrom.

18 Claims, 5 Drawing Figures

APPARATUS FOR CLEANING PHOTOSENSITIVE MEMBER OF ELECTROSTATIC COPYING MACHINE

BACKGROUND OF THE INVENTION

In an electrostatic copying machine of the dry developing and image transfer type, there is provided an apparatus for cleaning a photosensitive member in order to remove any residual toner therefrom after a toner image has been transferred, thus permitting a repeated use of the photosensitive member. A variety of cleaning apparatus are known in the art, including those utilizing a magnetic brush, a fur brush, a cleaning blade or the like.

In the electrostatic copying machine of the type described, a transfer step and a separation step are both essential. An observation of the surface of the photosensitive member after a toner image has been transferred and a transfer sheet has been separated reveals that the electric field on the photosensitive member is higher in regions corresponding to the leading and the trailing edge of the transfer sheet as compared with the electric field in the vicinity of these regions. Such phenomenon is explained as a result of the occurrence of a fringe field which occurs in a portion of the photosensitive member where a potential difference exists. Specifically, a portion of the photosensitive member on which a transfer sheet is held stationary has a different potential from another portion thereof where no transfer sheet is applied, when observed after the transfer sheet has been separated. The existence of such fringe field or peak field on the photosensitive member may cause toner present within a cleaning apparatus or around the end of the cleaning blade to be attracted onto the surface of the photosensitive member under the action of such field, to form a linear toner image. Such resulting toner image may not be cleaned by conventional cleaning apparatus, and hence may remain on the photosensitive member to be transferred to the next transfer sheet as a black streak extending in a direction perpendicular to the direction of movement of the member, thus greatly degrading the copy quality. The degree of appearance of such phenomenon greatly depends on the performance of the cleaning apparatus. It may appear under normal humidity conditions if the cleaning capability thereof is reduced. In particular, when a blade type cleaning apparatus is used and the cleaning capability of the apparatus is reduced to permit toner located on a region of a usual residual potential to be partly left on the photosensitive member and allowed to move or drift around the rear side of the blade, the rear portion of the blade edge will be contaminated, particularly when the peak electrode passes under the blade.

The contamination of the rear portion of the blade edge occurs not only when the cleaning capability is degraded, but also occurs in dependence upon the timing of releasing the blade from the photosensitive member. Specifically, when the blade is released from the photosensitive member after the latter has been completely stopped, the drift of the toner is minimized. In addition, a shift of the blade away from the photosensitive member is preferably reduced, to a value on the order of 0.1 to 0.3 mm. If a greater shift is chosen, the dispersion may cause the toner to drift around the rear portion of the blade edge, causing the occurrence of the black streak. In any event, the occurrence of the black streak is caused by the presence of a peak field on the surface of the photosensitive member, and can be prevented if the peak field is removed.

A residual potential on the photosensitive member may be eliminated by applying a corona discharge from a charger or by an irradiation with light. While the elimination of a residual potential from the photosensitive member through the corona discharge or the light irradiation is very efficient, it requires a complex arrangement, causing difficulties in the amount of space required and the resulting cost. By way of example, when a charger is used to remove the residual potential, it is necessary to provide a power supply unit which produces a high voltage. Additionally, the residual potential is reduced to zero or close to zero by utilizing a corona discharge which is either a.c. or d.c. which is of a negative and a positive polarity where the photosensitive member is charged to the positive and the negative polarity, respectively. However, depending on the environmental conditions or conditions of use, the potential cannot always be reduced to zero or close to zero after the neutralizing step, leaving the difficultiy that a uniform neutralization cannot be presumed.

When irradiation with light is used, the light intensity must be determined in accordance with the optical response of the photosensitive member. In addition, if the toner remains on the surface of the photosensitive member, the potential of the photosensitive member cannot be reduced in the regions beneath such toner. When the irradiation with light and the corona discharge are used in combination, there arises a problem that a region corresponding to the residual toner remains as a residual negative image, imposing limitations in the layout of the neutralization step within the overall process.

In a copying machine of dry type, the dispersion of toner may cause a contamination of a light emitter which is utilized to perform the light irradiation, changing the light output therefrom. Hence, the light output is generally preset to be higher than necessary. However, such choice of the light output prepresents an unnecessary power dissipation, which cannot be neglected, in particular, in a compact and high speed copying machine. In addition, the choice of a higher light irradiation accelerates the wear of the photosensitive member.

SUMMARY OF THE INVENTION

In view of the foregoing, it is an object of the invention to provide an apparatus for cleaning a photosensitive member of an electrostatic copying machine which eliminates the above difficulties.

This object of the invention is achieved in an electrostatic copying machine of dry developing and image transfer type in which a toner image formed on a photosensitive member is transferred onto a transfer sheet in a transfer station and any residual toner is removed by a cleaning apparatus located in a cleaning station, by providing a cleaning apparatus including neutralizing means electrically connected to the ground and which is disposed for contact with the surface of the photosensitive member in a region between the transfer station and the cleaning station.

In accordance with the invention, the provision of neutralizing means disposed for contact with the photosensitive member in a region between the transfer station and the cleaning station permits the peak voltage, which is produced as a result of the separation of a transfer sheet after it has a toner image transferred thereto, to be removed before it moves into the cleaning station, thereby preventing the peak field from being developed again in the cleaning station. Accordingly, the occurrence of a black streak on a next copy is eliminated, allowing a high copy quality to be maintained.

In accordance with another aspect of the invention, the neutralizing means comprises a thin conductive plate or sheet which is electrically connected to ground and which is disposed for contact with the photosensitive member, and this is all that is required to perform the neutralization of the photosensitive member. Hence, the arrangement is simple in construction, inexpensive to manufacture, and compact in respect of the space requirement. It will be appreciated that the invention dispenses with a high voltage generator which is required when a charger is used, improving the cost and the space requirements. In addition, the arrangement of the invention does not suffer from the problem of wear or fatigue of the photosensitive member which may be experienced when the light irradiation is utilized, permitting the arrangement to be used over a prolonged period of time.

According to a further aspect of the invention, the neutralizing means is formed as a thin plate or sheet, which is disposed for contact with the photosensitive member in a region below the cleaning station. This allows the thin plate to serve as a sealing member which prevents the dispersion of toner, in addition to the achievement of the intended neutralizing effect. Specifically, in the cleaning station, any residual toner is removed from the surface of the photosensitive member, and the removed toner falls down by gravity along the surface of the photosensitive member, causing the dispersion thereof. However, the neutralizing means may be utilized as a toner trap, thus avoiding the dispersion. The significance of this arrangement will be appreciated if one considered that in certain copying machines, part of the toner removed in the cleaning station may fall down onto a transfer sheet which is being conveyed from the transfer station toward a fixing station, causing a degradation in the copy quality.

DESCRIPTION OF EMBODIMENTS

Figure 1:
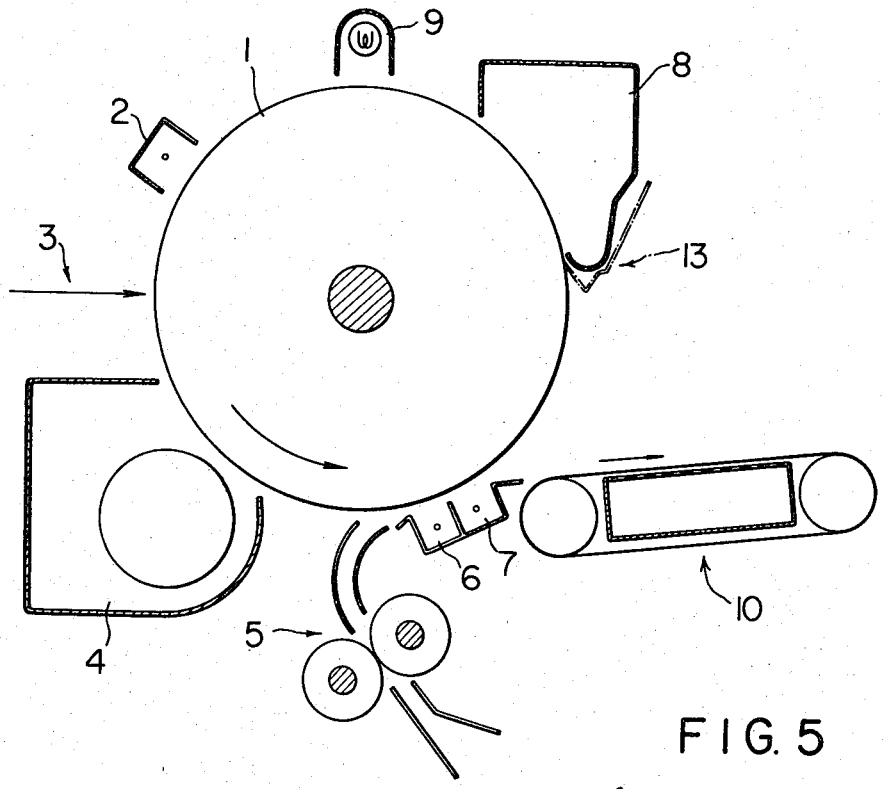
FIG. 1 is a schematic side elevation of an electrostatic copying machine of dry developing and image transfer type to which the invention may be applied.

Referring to FIG. 1, an electrostatic copying machine of dry developing and image transfer type will be initially described. The machine includes a photosensitive member 1 in the form of a drum which is adapted to rotate in a direction indicated by an arrow. Disposed around the drum 1 in the sequence named are a main charger 2 which charges the drum to a given polarity, an exposure station 3 which projects a light image of an original, not shown, onto the charged drum surface, a developing unit 4 which supplies toner to an electrostatic latent image formed in the exposure station to convert it into a visual image, a sheet feeder 5 for supplying a transfer sheet to the drum surface from a stack, not shown, a transfer charger 6 for effecting a corona discharge of the same polarity as the latent image from behind the transfer sheet to attract a toner image from the drum surface onto the transfer sheet, a separation charger 7 for effecting a corona discharge which is effective to separate the transfer sheet, having the toner image transferred thereto, from the drum surface, a cleaning apparatus 8 for removing any residual toner from the drum surface after the transfer step, and a quenching lamp 9 for removing any residual potential from the drum surface by light irradiation subsequent to the cleaning step. The transfer sheet separated from the drum 1 is conveyed to a fixing unit, not shown, by a conveyor unit 10.

A variety of arrangements including those utilizing a cleaning blade which may be formed by rubber and which may be brought into abutment against the drum surface, or a rotating member such as a fur brush which may be brought into contact with the drum surface, may be utilized to form the cleaning apparatus 8. While the invention is not limited to any particular configuration of the cleaning apparatus, a blade cleaning apparatus is illustrated herein.

Figure 2:
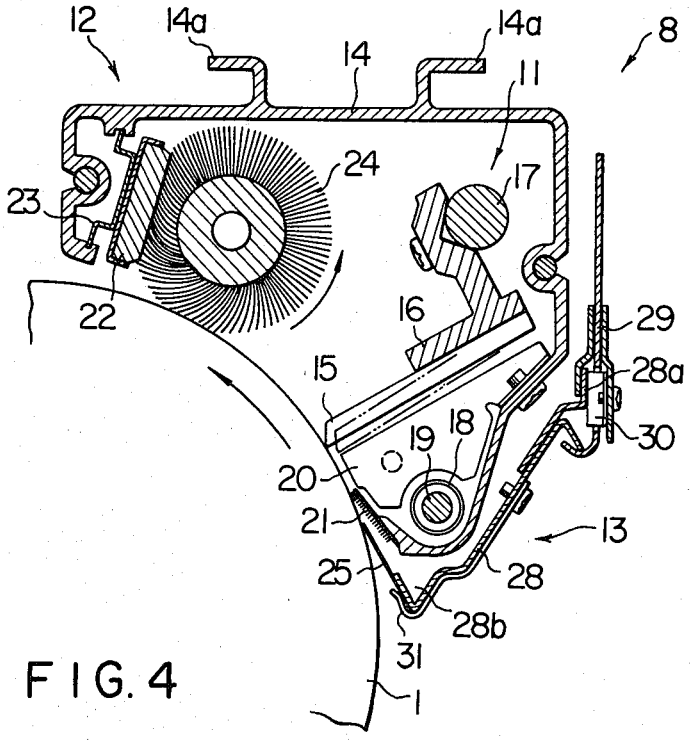
FIG. 2 is a side elevation, partly in section, of one embodiment of the invention.
Figure 4:
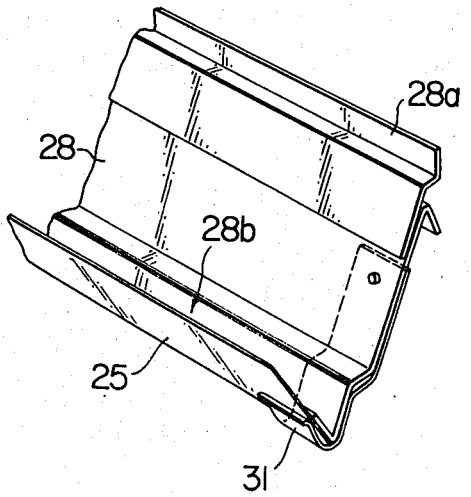
FIG. 4 is a fragmentary perspective view of the embodiment of FIG. 2.

The invention is concerned with the arrangement of the cleaning apparatus 8, the detail of which is shown in FIG. 2. The cleaning apparatus 8 essentially comprises a cleaning section 11, a applicator 12 and a neutralizing section 13. Both the cleaning section 11 and the applicator 12 are enclosed in a casing 14.

The cleaning section 11 comprises a cleaning blade 15 formed of an elastic material such as rubber, a blade holder 16 fixedly carrying the blade, a rotary shaft 17 on which the holder 16 is fixedly mounted, and a drive mechanism, not shown, which is connected to the driving shaft to cause it to rotate through a given angle. During a copying operation, the drive mechanism operates through the rotary shaft 17 to maintain the cleaning blade 15 in abutment against the drum surface at its free end while at the termination of the copying operation, the free end of the blade is moved away from the drum by a distance from 0.1 to 0.3 mm, as indicated by phantom line. The purpose of cleaning blade 15 is to scrape any residual toner from the drum surface, and the removed toner is collected in a toner recovery section disposed in the lower portion of the casing 14. Also disposed in the lower portion of the casing 14 is a toner conveying mechanism including a coiled spring 18 and a shaft 19 which causes the spring 18 to rotate in a given direction, thus conveying the collected toner to the developing unit 4 (FIG. 1) or to a recovery bag, not shown. An agitator 20 is disposed between the blade 15 and the toner conveying mechanism for preventing a solidification of the toner. A mechanism, not shown, imparts an oscillation to the agitator 20 to cause it to oscillate in the axial direction of the drum.

As shown, the casing 14 has an opening which faces the drum 1. A first seal member 21 is secured to the lateral edge of the opening to provide a seal between the casing 14 and the drum 1. The surface of the first seal member 21 which contacts the drum is implanted with hairs. The purpose of the first seal member 21 is to prevent the toner from dispersing outside the casing as it is scraped off by the cleaning blade 15. While not shown, seal members formed of a sponge rubber or the like are provided between the opposite ends of the casing 14 and the opposite ends of the drum 1.

The applicator 12 functions to supply a material having a low coefficient of friction to the drum surface in order to reduce the friction between the cleaning blade 15 and the drum surface, and the mechanical adherence between the toner and the drum, thus improving the cleaning performance and alleviating any damage which may be caused to the blade and the drum surface. A body 22 of coating material is secured to the casing 14, and comprises a block of a material having a low coefficient of friction such as zinc stearide, which is carried by a holder 23. The casing 14 is provided with a guide in which the rail portion of the holder 23 is freely passed. The body 22 is engaged by an applicator brush 24, which is formed of a material such as rayon or polypropylene. The brush 24 also contacts the drum surface, and is driven to rotate counterclockwise, by a drive mechanism, not shown. It is to be understood that both the applicator brush 24 and the body 22 have lengths which are approximately equal to the axial length of the drum 1 so that the coating material in powder form may be applied to the full peripheral surface of the drum.

The casing 14 which internally houses the cleaning section 11 and the applicator 12 is provided with a pair of rails 14*a*, which are detachably mounted on the body of the copying machine.

The neutralizing section 13 comprises a neutralizing member disposed for contact with the drum surface and carried by a bracket. In the embodiment shown, the neutralizing member is disposed in close contact with the drum surface to serve as a trap for the toner which is scraped off in the cleaning section 11 and by the first seal member 21, and is therefore referred to herein as a second seal member 25.

Figure 3:
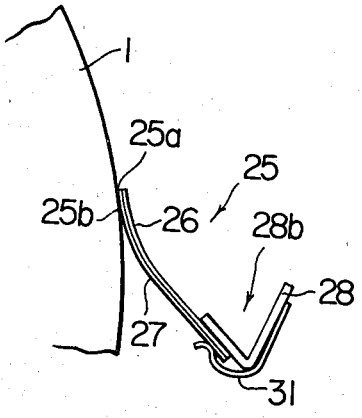
FIG. 3 is an enlarged, fragmentary side elevation, partly in cross section, of the embodiment of FIG. 2.

The second seal member 25 comprises a thin resilient conductive plate, and contacts the drum surface along a generatrix thereof over the full axial length thereof. A suitable material for the second seal member 25 is a conductive metal, such as aluminium, copper, stainless steel or any alloy thereof, which is shaped as a sheet of a single layer of material. Alternatively the second seal member 25 may comprise a resilient substrate 26 formed of a polyester film, commonly referred to as Mylar TM, and a thin conductive layer 17 as may be formed by the evaporation of aluminium or gold, for example, onto the surface of the substrate which opposes the drum, thus providing a multi-layer construction as illustrated in FIG. 3. At any rate, the second seal member 25 is fixedly carried by a bracket 28, and its free end 25*a* or preferably its major surface 25*b* adjacent thereto is resiliently urged against the drum surface.

The bracket 28 is formed of a conductive material, and is V-shaped in cross section. The second seal member 25 is fixedly connected to one limb of the bracket while the other limb is provided with a rail 28*a* so that it may be detachably mounted on a guide member 29 which is in turn secured to the body of the copying machine. The guide member 29 is formed of a conductive material, and is electrically connected to the body of the copying machine which represents electrical ground. A leaf spring 30 secured to the guide member 29 is disposed between the rail 28*a* and the guide member 29 to achieve a reliable electrical connection therebetween and to position the second seal member.

The bracket 28 is partly folded back to define a toner receiver 28*b*. There is provided a leaf spring 31 secured to the bracket 28 which is electrically connected to ground in order to provide an electrical connection between the conductive layer 27 and the bracket 28 when the multi-layer construction as illustrated in FIG. 3 is utilized, even though there is no need for such leaf spring when the second seal member 25 comprises a single conductive sheet. It will be appreciated that the leaf spring 31 engages the conductive layer 27. Accordingly, the second seal member 25 is electrically coupled to the bracket 28 either directly or through the leaf spring 31, and the bracket 28 is connected through the guide member 29 to the body of the copying machine, which represents ground.

The second seal member 25 is urged against the drum surface with a pressure of contact which is sufficient to provide an electrical conduction therebetween. If the pressure is excessively high, it will operate to remove toner from the drum surface, which is undesirable. Hence, it must be disposed to allow the passage of the toner.

In addition, if the second seal member 25 is urged against the drum so that only its leading end contacts the drum, the toner may be scraped off and also the drum surface may be damaged. Hence, it is preferred that the major surface 25*b* of the free end portion of the second seal member 25 be brought into contact with the drum surface so that the free end thereof represents a tangent to the drum. An optimum mounting is achieved by choosing the resilience of the second seal member 25 and the location of the bracket 28.

In the cleaning apparatus of the invention in which neutralizing means connected to the ground is disposed in contact with the drum surface in a region between the transfer station and the cleaning station, any residual charge remaining on the photosensitive member after the transfer step will be discharged through the neutralizing means, or the second seal member 25 in the present embodiment. Hence, the charge which would otherwise form peak fields at locations corresponding to the leading and the trailing end of the transfer sheet as it is held close against the photosensitive member, after the transfer and the separation of the sheet therefrom, is substantially eliminated by the provision of the second seal member 25, preventing them from being developed again at the cleaning station 11. In this manner, the occurrence of a black streak on a subsequent copy is prevented.

The removal of the toner in the cleaning station is facilitated as a result of neutralizing the photosensitive member before the residual toner is scraped off by the cleaning blade. In this manner, the cleaning performance is improved while reducing the load on the cleaning blade.

Since the neutralizing means also serve as a trap for the toner which falls down from the cleaning station to thereby prevent a contamination of the transfer sheet or the like by dispersion, a dispersion of the toner into the copying machine, in particular, onto the transfer sheet is effectively prevented, contributing to maintaining the copy quality.

From the standpoint of utilizing the neutralizing means to serve as a seal member, it is more effective that the neutralizing means define an areal contact rather than a lineal contact with respect to the drum. A facial contact of the free end of the seal member 25 can be achieved by forming the second seal member 25 as a multi-layer construction illustrated in FIG. 3, forming the resilient substrate 26 of a dielectric material such as Mylar and reducing the thickness of the conductive layer 27 consistent with the maintenance of its function.

Since the second seal member 25 has its conductive layer 27 disposed in contact with the drum 1 or more specifically, has its major surface 25*b* disposed for contact with the drum surface, its free end 25*a* tends to extend in the tangential direction of the drum. However, there remains some charge on the drum even after the neutralizing action by the neutralizing member, and the combination of the drum and the conductive layer 27 forms a closed circuit, so that it is believed that an electrostatic force acting therebetween causes the free end 25*a* of the member 25 to be held tightly against the drum surface. In this instance, if the second seal member 25 is excessively thick, the rigidity of the neutralizing member itself prevents the free end from being tightly held against the drum, resulting in a difficulty to adjust the pressure of contact with the drum surface. Conversely, if the second seal member 25 is excessively thin, the substrate 26 may become corrugated as a result of heat of friction with the drum, resulting in an imperfect contact with the drum over the full length. By experiment, it is found that a good neutralizing and sealing effect is achieved with a final thickness of the second seal member 25 on the order of 30 to 70 microns after aluminium is evaporated to a thickness of 3 microns to form the thin conductive layer 27. Greater and lesser thickness resulted in the difficulties mentioned above.

To recapitulate, where the neutralizing means is to function as a contamination preventive member also, the likelihood that toner falling down from the cleaning station may accumulate on the free end region thereof makes it desirable that the free end region be formed as thin as possible consistent with the requirement to prevent the corrugation.

When the stainless steel is used, the second seal member can be formed very thin. A sheet having a thickness from 10 to 30 microns provides a satisfactory neutralizing and contamination preventing effect.

Figure 5:
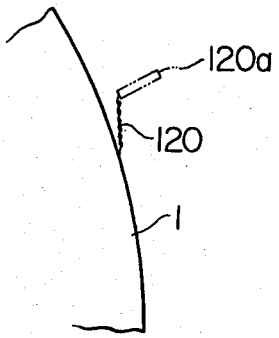
FIG. 5 is a side elevation of essential parts of another embodiment of the invention.

Rather than a single resilient plate disposed along the generatrix of the drum, neutralizing members 120 may be used which are carried by a support 120*a* for contact with the drum surface as shown in FIG. 5. A plurality of neutralizing members are carried by the support 120*a* extending substantially in the direction of the generatrix of the drum 1 so that their free end is disposed in contact with the drum surface without substantial gap between them as viewed in said direction. These members may be urged against the drum surface either by resilience of the material which is used to form them or by gravity. Obviously, the support 120*a* is connected to ground. It will be noted that this arrangement provides only the neutralizing effect, without the toner trap function.

As discussed above, in accordance with the invention, peak fields are eliminated before they can be developed again, by the provision of neutralizing means disposed in contact with the photosensitive member. The arrangement is simple in construction and inexpensive to provide, and reduces the space requirement and the cost as compared with the conventional neutralizing means which utilize the corona discharge and light irradiation. The neutralizing effect is achieved by merely disposing the second seal member in contact with the photosensitive member, and hence is ever-lasting without causing a degradation of the photosensitive member.

What is claimed is:

1. An apparatus for cleaning a photosensitive member of an electrostatic machine forming visible images from a dry developer in which a toner image formed on the photosensitive member is transferred to a transfer sheet in a transfer station and any residual toner is removed in a cleaning station having an element adapted to engage said photosensitive member for removing residual toner therefrom; characterized by the provision of neutralizing means electrically grounded and disposed for contact with the surface of the photosensitive member in a region between the transfer station and the element of said cleaning station.

2. An apparatus according to claim 1, said element being comprised by a cleaning blade having a free end selectively brought into contact with the surface of the photosensitive member.

3. An apparatus according to claim 1, said element being comprised by a cleaning blade, and said apparatus further including a solid body of a lubricant material disposed downstream of the cleaning blade as viewed in the direction of movement of the photosensitive member, and a applicator for applying the lubricant material to the surface of the photosensitive member.

4. An apparatus according to claim 1 which includes a casing having an opening which faces the photosensitive member, and a first seal member disposed in the opening and extending in a direction perpendicular to the direction of movement of the photosensitive member, the free end of the first seal member being implanted with hairs which are in contact with the surface of the photosensitive member to provide a seal between the latter and the casing.

5. An apparatus according to claim 1 further including a casing having a bottom portion adapted to collect toner removed from said photosensitive member and a toner conveying mechanism located in said bottom portion for carrying the collected toner out from the apparatus.

6. An apparatus according to claim 1, further including an agitator which prevents a solidification of collected toner.

7. An apparatus according to claim 1 in which said neutralizing means comprises a single conductive metal sheet extending in the direction of generatrix of the photosensitive member.

8. An apparatus according to claim 1 in which the neutralizing means comprises a resilient substrate member, a conductive thin layer formed on a surface of the substrate member and adapted to be in contact with the photosensitive member, means for connecting the conductive thin layer with electrical ground, and a support carrying the resilient substrate.

9. An apparatus according to claim 1 including means for mounting the neutralizing means detachably to the copying machine.

10. An apparatus according to claim 1 the neutralizing means comprises a support extending in the direction of the generatrix of the photosensitive member and a plurality of conductive strips carried by the support, said strips each being arranged such that portions thereof contact the surface of the photosensitive member.

11. An apparatus according to claim 3 further including a casing and means mounting the body of lubricant material detachably to the casing.

12. An apparatus according to claim 3 in which the applicator comprises a fur brush.

13. An apparatus according to claim 7 or 8 in which the neutralizing means is formed as a seal member disposed upstream of the cleaning station as viewed in the direction of movement of the photosensitive member and disposed for contact with the surface of the photosensitive member, the seal member serving as a trap for toner which falls down from the cleaning station.

14. An apparatus according to claim 7 or 8 in which a major portion of the surface of the neutralizing means in the vicinity of its free end is disposed in contact with the surface of the photosensitive member.

15. An apparatus according to claim 8 in which the resilient substrate comprises a sheet of dielectric material.

16. An apparatus according to claim 8 in which the conductive thin layer is formed by evaporating aluminium.

17. An apparatus according to claim 8 which includes a casing and the support is detachably mounted on the copying machine independently from the casing.

18. An apparatus according to claim 8 in which the support is provided with a toner receiver.

* * * * *